United States Patent [19]

D'Alessio

[11] 4,042,167

[45] Aug. 16, 1977

[54] DIE CUT BLANK AND TRAY ASSEMBLED THEREFROM

[75] Inventor: Joseph R. D'Alessio, Wilbraham, Mass.

[73] Assignee: Champion International Corporation, Stamford, Conn.

[21] Appl. No.: 756,626

[22] Filed: Jan. 4, 1977

[51] Int. Cl.[2] ..... B65D 5/22

[52] U.S. Cl. ..... 229/34 HW; 229/8

[58] Field of Search ..... 229/8, 34 R, 34 HW, 229/32

[56] References Cited

U.S. PATENT DOCUMENTS

| | | | |
|---|---|---|---|
| 1,568,982 | 1/1926 | Lengsfield | 229/8 |
| 2,154,084 | 4/1939 | Bergstein | 229/8 UX |
| 2,495,807 | 1/1950 | Buttery | 229/34 HW UX |
| 2,597,289 | 5/1952 | Caskey | 229/8 X |
| 2,765,113 | 10/1956 | Williamson | 229/34 HW |
| 3,136,473 | 6/1964 | Kieffer | 229/34 HW |
| 3,722,668 | 3/1973 | Carpenter | 229/34 HW X |
| 3,981,431 | 9/1976 | Matsuyama | 229/8 X |

*Primary Examiner*—Davis T. Moorhead
*Attorney, Agent, or Firm*—Evelyn M. Sommer

[57] ABSTRACT

A novel extended edge tray assembled from a single blank of paper stock is provided, the blank including a major and a minor panel integrally connected along a foldable flange-forming spine. The major panel is dimensionally larger than the minor panel. Other discretely foldable flange-forming members are formed along the edges of the minor panel. To assemble the tray, the flange is formed in the spine and the minor panel is rotated 180° until it overlies the major panel. The minor panel is secured to the major panel and the flanges are formed therein. Means provided for interlocking adjacently abutting flanges and corners defined therebetween are integrally formed with the assembly. None of the cut edges of the blank are exposed in the assembled tray. A suitable cover may be telescoped over the erect flanges for covering the open tray.

11 Claims, 8 Drawing Figures

DIE CUT BLANK AND TRAY ASSEMBLED THEREFROM

BACKGROUND OF THE INVENTION

The instant invention relates generally to paperboard cartons and, more particularly, to a novel die cut blank and the paperboard tray assembled therefrom.

Heretofore known extended edge paperboard trays, for instance of the type in which confections are packaged, have been assembled from plural adhesively connected blanks, such as is disclosed in U.S. Pat. No. 1,758,511 to Gross. Other heretofore known extended edge paperboard trays assembled from a unitary blank, such as disclosed in U.S. Pat. No. 914,321 to Syner, have required the use of paper gussets to erect adjacent side walls of the tray, while exposing cut edges of the blank in the assembly.

Blanks of the former known type are expensive and bulky; and the trays erected therefrom are difficult to assemble. Trays erected from the latter known type blank are unstable, since the side walls thereof are not integrally connected. Also, the exposed cut edges of the assembled tray may fray, or perhaps inflict a cut upon the hand of its assembler or user. These prior blanks and trays are, therefore, unsatisfactory.

Accordingly, the instant invention provides a unitary blank which is assembled into an extended edge paperboard tray having a reinforced bottom panel, an integral construction, and non-abrasive edges.

SUMMARY OF THE INVENTION

Generlly speaking, in accordance with the invention, a novel extended edge tray is assembled from a single blank of paper stock which includes a major and a minor panel integrally connected along a foldable flange-forming spine. The major panel is dimensionally larger than the minor panel. Other discretely foldable flange-forming members are formed along the edges of the minor panel.

To assemble the tray, the flange is formed in the spine and the minor panel is rotated 180° until it overlies the minor panel. The minor panel is secured to the major panel and the flanges are formed therein. The errect flanges are recessed from the edge of the major panel and substantially normal to the plane thereof. The blank includes means for interlocking adjacent erect flanges; therefore, interior corners of the tray are integrally formed between interlocked adjacent flanges.

The flanges of the tray assembly are all formed along embossed fold lines in the flange-forming members, including the spine. Also, the major panel includes inwardly foldable end flaps underlying the erect minor panel. Therefore, none of the cut edges of the blank are exposed in the assembled tray.

As assembled, the flanges are arranged to enclose an area on the major panel having linear dimensions substantially equal to the planar dimensions of the overlying minor panel. The upstanding flanges form the lip of a shell in which, for instance, candies or the like may be packed. The shell may be overfitted with a conventional telescoping cover, thereby fully housing the goods removably mounted in the shell of the tray.

A particularly appealing commercial feature of the invention relates to the manner of assembly of the tray from the blank which permits partial assembly of the tray before shipping, and shipment of a knocked-down form of the partially assembled tray.

Accordingly, it is an object of the invention to provide a novel die cut blank from which a composite tray may be assembled.

Another object of the invention is to provide an extended edge tray having a novel construction.

A further object of the invention is to provide a tray wherein corners of the shell thereof are integrally formed with the unit.

Still another object of the invention is to provide an assembled tray having only integrally formed embossed edges exteriorly shown.

Still other objects and advantages of the invention will in part be obvious and will in part be apparent from the specification.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE INVENTION

Figure 1:
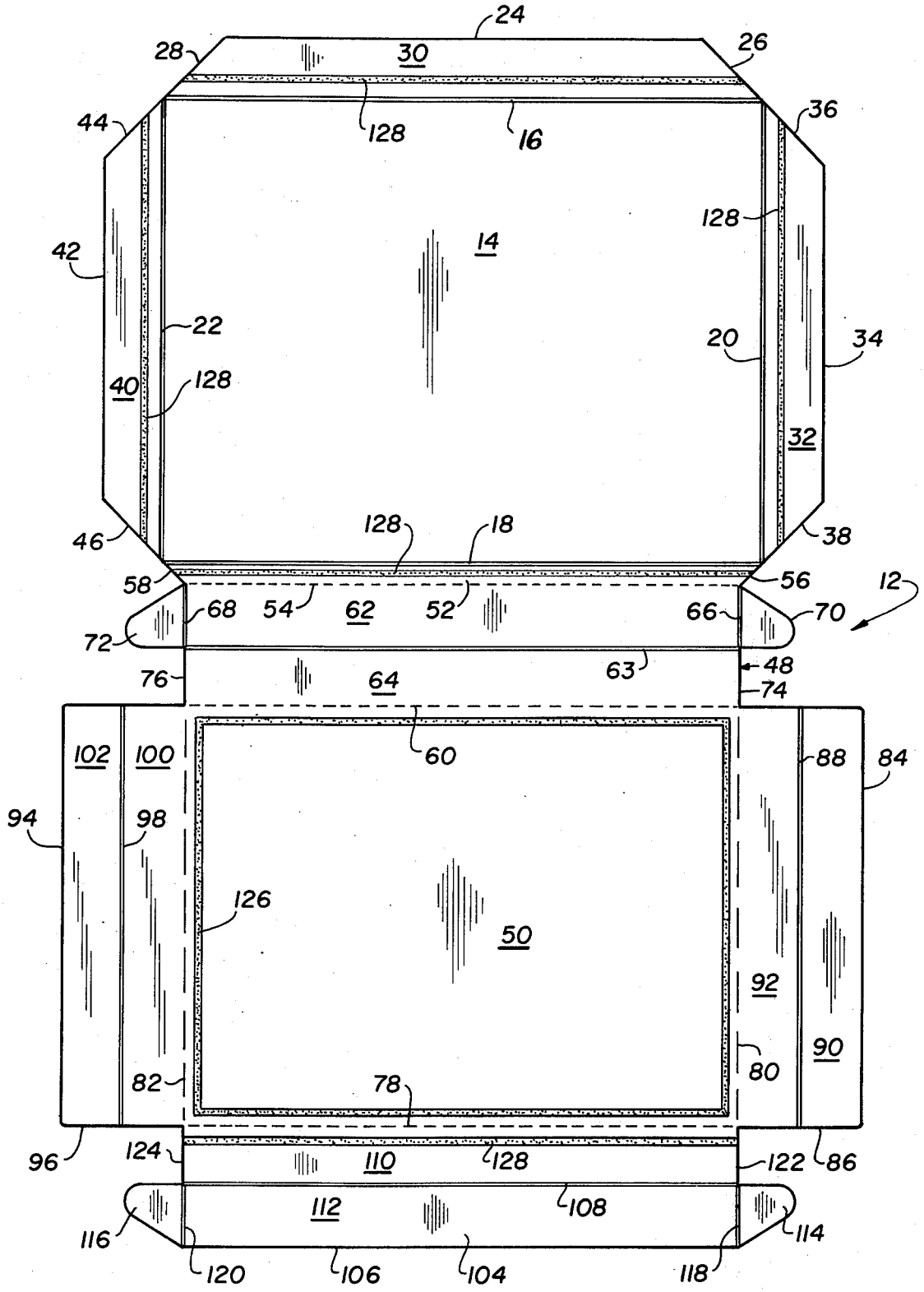
FIG. 1 is a plan view of the die cut blank from which the tray is assembled.
Figure 5:
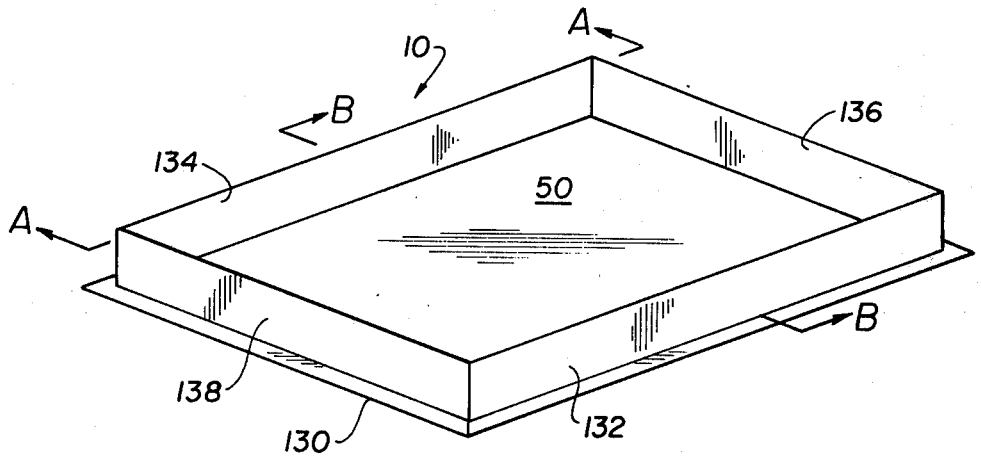
FIG. 5 is a perspective view of the assembled tray.

Referring now to the Figures, a tray generally numbered 10, best seen in FIG. 5, is assembled from a blank 12, seen in FIG. 1, generally comprising a single piece of substantially polygonally shaped paper stock, such as a paperboard. The blank 12 includes a bottom panel 14 defined between first and second substantially parallel longitudinal embossed fold lines 16 and 18, and corresponding first and second substantially parallel transverse embossed fold lines 20 and 22 intersecting therewith at substantially right angles.

Bounded between the longitudinal fold line 16 and a first longitudinal edge 24 of the blank 12, and by miter cuts 26 and 28 therein is a first upwardly foldable end flap 30 of the bottom panel 14. A second upwardly foldable end flap 32 is bounded by the transverse fold line 20, a first transverse edge 34 of the blank 12, and miter cuts 36 and 38; and a corresponding third upwardly foldable end flap 40 is similarly bounded by transverse fold line 22, a second transverse edge 42 of the blank 12, and miter cuts 44 and 46.

Coupling bottom panel 14 to a flange-forming spine 48, which integrally connects the bottom panel 14 to a top panel 50 located on the blank 12, is an inwardly foldable panel strip 52 bounded by longitudinal fold line 18, a first longitudinal score line 54 substantially parallel thereto, and miter cuts 56 and 58. The flange-forming spine 48 is determined in the blank 12 between the first longitudinal score line 54 and a second longitudinal score line 60 substantially parallel thereto. A third axially extended longitudinal embossed fold line 63 provided in the flange-forming spine 48 defines first and second flange reinforcing panels 62 and 64, respectively, therein.

Hingedly connected to the flange reinforcing panel 62 along respectively embossed third and fourth transverse fold lines 66 and 68 are first and second mirror-image asymmetric tabs 70 and 72, respectively. The flange reinforcing panel 64 is bounded by a third and a fourth transverse edge 74 and 76, respectively, of the blank 12 which is linearly aligned with a corresponding transverse fold line 66 or 68 bounding panel 62.

The top panel 50 is defined in an area of the blank 12 by the score line 60, a third longitudinal score line 78 parallel thereto, and first and second substantially parallel transverse score lines 80 and 82 which respectively intersect the score lines 60 and 78 at substantially right angles.

Bounded between the transverse score line 80 and a fifth transverse edge 84 of the blank 12 is a first rectangular flange forming panel 86 having a fifth axially extended transverse embossed fold line 88 therein defining a third flange reinforcing panel 90 and a fourth flange reinforcing panel 92. Correspondingly bounded by the transverse score line 82 and a sixth transverse edge 94 of the blank 12 is a second rectangular flange forming panel 96, similarly having a sixth axially extended transverse embossed fold line 98 therein correspondingly defining fifth and sixth flange reinforcing panels 100 and 102, respectively.

A flange forming member 104 structurally similar to the spine 48 lies laterally adjacent the top panel 50, being bounded by the score line 78 and a second longitudinal edge 106 of the blank 12. The member 104 includes a fourth axially extended longitudinal embossed fold line 108 which discretely defines seventh and eighth flange reinforcing panels 110 and 112, respectively, therein. A second pair of mirror image tabs 114 and 116, corresponding to the tabs 70 and 72, are respectively hingedly connected to opposite ends of the flange reinforcing panel 112 along respectively embossed seventh and eighth transverse fold lines 118 and 120, which are respectively linearly aligned with corresponding seventh and eighth transverse edges 122 and 124 of the blank 12 bounding the flange reinforcing panel 110.

For assembly of the tray 10 and intermediate products thereof from the blank 12, the blank 12 is selectively coated or printed with a suitable adhesive. As seen in FIG. 1, a continuous adhesive track 126 is provided marginally on the surface of the top panel 50, while a linear adhesive track 128 is respectively provided on the flange reinforcing panel 110, the panel strip 52, and the end flaps 30, 32 and 40 of the bottom panel 14.

Figure 2:
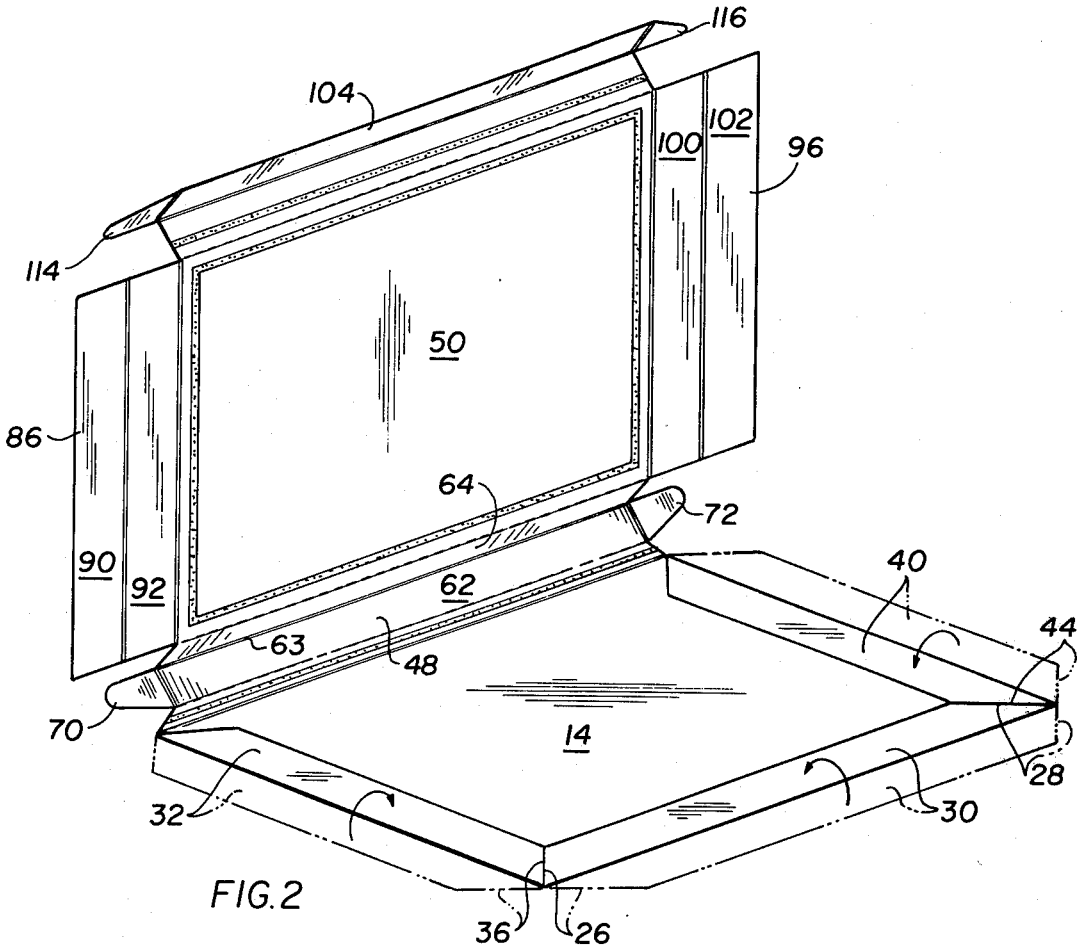
FIGS. 2 and 2A are isometric views showing a partial assembly of the tray from the blank of FIG. 1 and an assembly which is shipped from the manufacturer for final assembly by the user.
Figure 3:
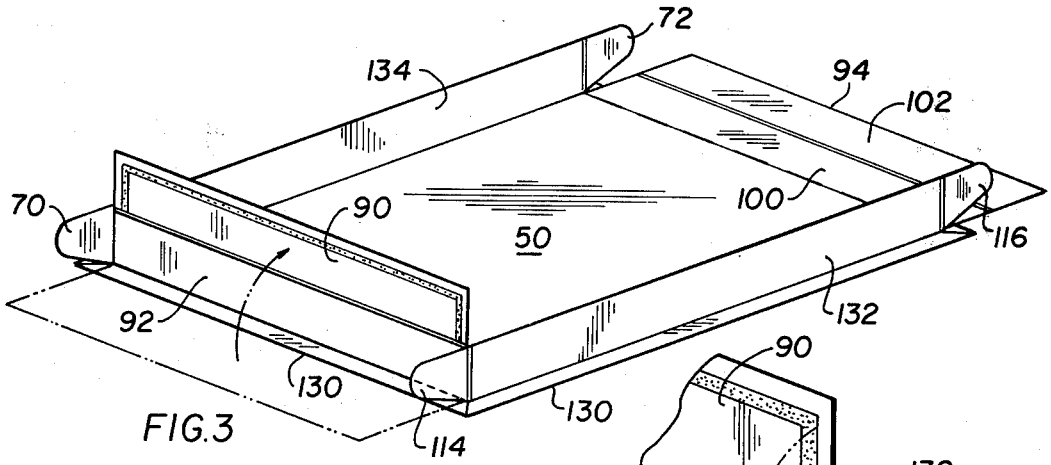
FIG. 3 is a view of the assembly, partially erected by the final user.
Figure 4:
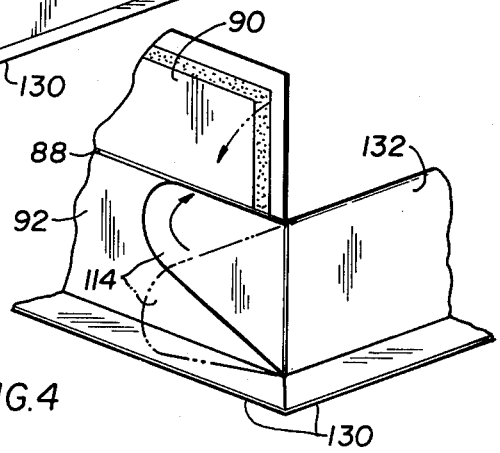
FIG. 4 is a fragmentary detail view showing assembly of a corner of the tray.

With particular reference to FIGS. 1, 2 and 4, it may be seen that the miter cuts 28 and 44, and 26 and 36, in respectively adjacent end flaps 40, 30 and 32 obliquely intersect at obtuse angles on the blank 12. Substantially the same angular relationship exists between the miter cuts 56, 58 in the panel strip 52 and the respectively adjacent cuts 38 and 46, respectively in end flaps 32 and 40. In folded adhesively secured relationship overlying bottom panel 14, the adjacent miter cuts in the respectively adjacent end flaps and the panel strip 52 are substantially coincidential, and the corresponding end flaps and the panel strip lay in complementary relationship.

To assembly the tray 10 and intermediate products thereof from the blank 12, as best seen in FIGS. 1–5, the end flaps 30, 32 and 40 are respectively folded on corresponding fold lines 16, 20 and 22 through a 180° angle until each discrete adhesive track 128 thereof overlies the bottom panel 14 to partially form a finished extended edge 130 of the tray 10. Panel 112 of the flange forming member 104 is folded along fold line 108 to overlie the panel 110 thereof, and sealed thereto along the adhesive track 128 to form a first flange 132 of tray 10. A second flange 134 of tray 10 is formed by congruently folding the panels 62 and 64 of the flange forming spine 48 on fold line 63 thereof, and reversely folding the blank 12 on the congruent score lines 52 and 60.

Figure 6:
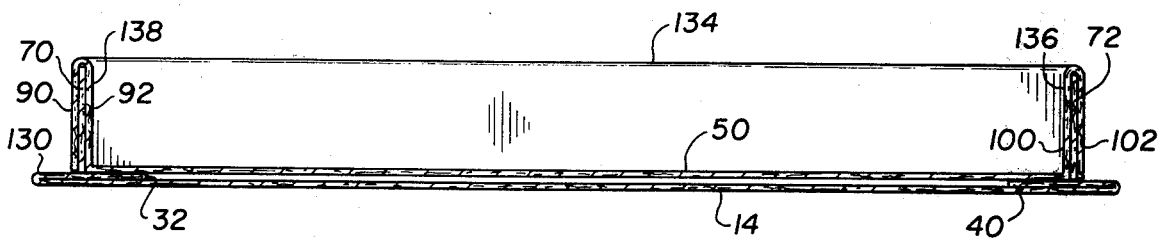
FIG. 6 is a sectional view of the tray taken along line A—A of FIG. 5.
Figure 7:
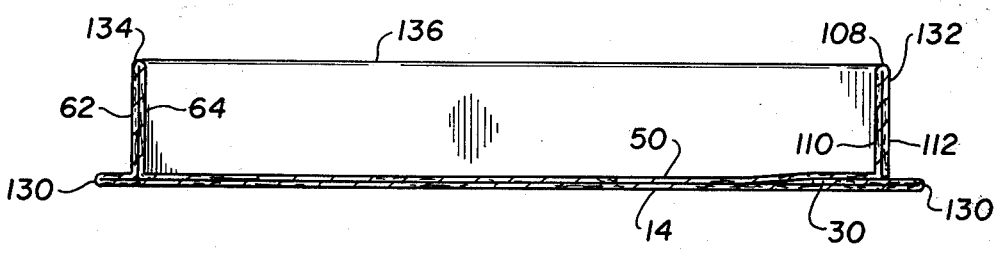
FIG. 7 is a sectional view of the tray taken along line B—B of FIG. 5.

The flange 134 is raised normally relative to the top panel 50 by folding on score line 78 thereof. To complete the finished extended edge 130 of the tray 10, the panel strip 52 is folded on fold line 18 to overlie the bottom panel 14 and adhesively sealed thereto on the adhesive track 128. Concurrently, the top panel 50 is pivoted to overlie the bottom panel 14. Underlying the pivoted top panel 50 are sealed flaps 30, 32 and 40, and the top panel 50 is sealed thereto on adhesive track 126, as seen in FIG. 6. The section of the top panel 50, adjacent to the sealed panel strip 52, which directly overlies the bottom panel 14 is sealed thereto on the adhesive track 126, as seen in FIG. 7.

Figure 2A:
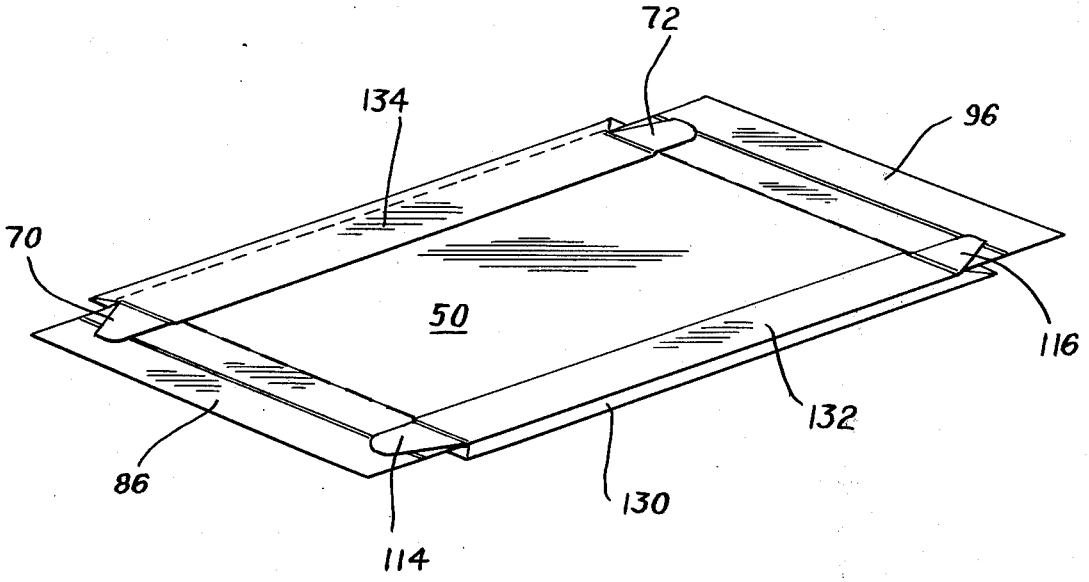

As thus partially assembled, as seen in FIG. 2A, with the rectangular flange forming panels 86 and 96 of the blank 12 in the plane of the top panel 50 and with the flanges 132 and 134 folded downwardly movably overlying the top panel 50, the glued flat blank is in convenient form for packing and shipping to the final assembly packing site.

To complete the assembly, flanges 132 and 134 are raised normally to the plane of the top panel 50, rectangular flange forming panels 86 and 96 are raised respectively on score lines 80 and 82 at normals to the top panel 50 and the corresponding outer surfaces thereof are adhesively coated. The pairs of tabs 70, 114 and 72, 116 are folded inwardly and secured to the respective adhesive coated surfaces of the panels 86 and 96, as seen in FIG. 4. The flange reinforcing panels 90 and 102 of respective flange forming panels 86 and 96 are folded outwardly on respective fold lines 88 and 98 into congruent adhesive connection on corresponding flange reinforcing panels 92 and 100, each respectively overlying a pair of tabs 70, 114 or 72, 116, and thus a third flange 136 and a fourth flange 138 of the tray 10 are formed, completing the tray assembly.

The flanges 132, 134, 136 and 138 of the tray 10 are integrally connected by means of the adhesively sealed tabs 70, 114 and 72, 116; and together with the overlying panels 14 and 50 form a reinforced composite shallow shell in which items, such as candies, may be packed and covered, for instance with a cover member telescoping over the flanges 132, 134, 136 and 138. Such a telescoping cover is supportable on the reinforced extended edge 130 of the tray 10.

It will thus be seen that the objects set forth above, among those made apparent from the preceding description, are effeciently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A carton tray comprising a base member, and a plurality of side wall flanges upstanding thereon in adjacent continuous relationship; said base member comprising an integrally connected bottom and top panel, said top panel concentrically overlying said bottom panel; said base member including a continuous marginal flange extending outwardly beyond said side wall flanges upstanding thereon; said plurality of side wall flanges being formed form a corresponding plurality of discrete continuations of said top panel, one of said corresponding plurality of discrete continuations of said top panel being a commonly discrete continuation of said bottom panel.

2. The carton tray as claimed in claim 1, said continuous marginal flange comprising continuations of said bottom panel folded back upon marginal portions thereof, and secured throughout their extent to said marginal portions.

3. The carton tray as claimed in claim 2, said continuations of said bottom panel comprising plural discrete end flaps hinged to said bottom panel on a corresponding plurality of fold lines, and a marginal flange defining strip defined between first and second fold lines in said discrete continuation commonly continued between said top and bottom panels.

4. The carton tray as claimed in claim 3, said plural discrete end flaps and said marginal flange defining strip being respectively mitered at their ends to overlie said bottom panel in complementary relationship.

5. The carton tray as claimed in claim 1, each of said side wall flanges comprising a congruent pair of flange reinforcing members hinged along a fold line for their extent.

6. The carton tray as claimed in claim 5, each adjacent pair of side wall flanges of said plurality thereof having a point of intersection and being reinforced thereat by a folded corner construction, said corner construction comprising a continuation of one of said flange reinforcing members of one side wall flange of said pair thereof folded into the plane of a second side wall flange of said pair thereof and fixedly mounted between said congruent flange reinforcing members of said second side wall flange.

7. The carton tray as claimed in claim 6, said continuation of one of said flange reinforcing members comprising an asymmetric tab hinged to said flange reinforcing member by a fold line, said asymmetric tab having a substantially linear edge underlying said fold line between said congruent flange reinforcing members of said second side wall flange.

8. The carton tray as claimed in claim 6, wherein said side wall flanges of said adjacent pairs thereof respectively lie in planes substantially normal to each other.

9. The carton tray as claimed in claim 1, wherein said base member and said plurality of said wall panels are formed from a single piece of stock.

10. The carton tray as claimed in claim 9, wherein said stock is a flexible paper stock.

11. A preform assembly for a carton tray comprising a base member, and a plurality of said wall flanges hingedly connected thereto lying substantially in the plane of said base member; said base member comprising an integrally connected bottom and top panel, said top panel concentrically overlying said bottom panel; said base member including a continuous marginal flange extending outwardly beyond said top panel; said plurality of side wall flanges being formed from a corresponding first plurality of discrete continuations of said top panel, one of said corresponding first plurality of discrete continuations of said top panel being a commonly discrete continuation of said bottom panel; said top panel including a second plurality of discrete continuations thereof lying in the plane thereof, said second plurality of discrete continuations being foldable into a corresponding second plurality of side wall flanges.

* * * * *